US005199700A

United States Patent [19]

Fairey et al.

[11] Patent Number: 5,199,700

[45] Date of Patent: Apr. 6, 1993

[54] DOCUMENT STACKING APPARATUS

[75] Inventors: Richard A. Fairey, Kitchener; Kenneth S. Seymour, Conestogo, both of Canada

[73] Assignee: NCR Corporation, Dayton, Ohio

[21] Appl. No.: 764,416

[22] Filed: Sep. 23, 1991

[51] Int. Cl.[5] ..... B65H 29/70; B65H 31/26; B65H 29/38

[52] U.S. Cl. ..... 271/209; 271/177; 271/188; 271/220

[58] Field of Search ..... 271/177, 178, 188, 209, 271/220

[56] References Cited

U.S. PATENT DOCUMENTS

| | | | |
|---|---|---|---|
| 3,087,724 | 4/1963 | Snowdon et al. | 271/188 |
| 3,139,278 | 6/1964 | Maidment | 271/188 |
| 3,595,565 | 7/1971 | Bergland | 271/188 |
| 4,251,000 | 2/1981 | Templeton | 271/209 |
| 4,640,505 | 2/1987 | Placke et al. | 271/209 |
| 4,732,375 | 3/1988 | Tetherton | 271/209 |
| 4,964,627 | 10/1990 | Watts et al. | 271/209 |
| 5,094,660 | 3/1992 | Okuzawa | 271/209 |

FOREIGN PATENT DOCUMENTS

| | | | |
|---|---|---|---|
| 1524504 | 7/1970 | Fed. Rep. of Germany | 271/188 |

*Primary Examiner*—Robert P. Olszewski
*Assistant Examiner*—Steven M. Reiss
*Attorney, Agent, or Firm*—Elmer Wargo

[57] ABSTRACT

A high speed apparatus for pocketing documents in a pocket. A document to be pocketed is diverted from a document track towards a cupping apparatus by a pocket selector. The cupping apparatus includes an initial cupping rib and first, second, and third drive rollers, with a metal pinch roller being positioned opposite the second drive roller to cup a document to be pocketed. The leading edge of the cupped document encounters a document spring to create a "travelling wave" which functions to push the trailing edges of documents already pocketed away from an entry point to the pocket to enable the document to be pocketed to enter the pocket without collision and to enter in the right order. The document spring has a rectangular opening in each end thereof to enable the end to be secured to a rectangular boss located on a guide member within the apparatus to provide a quick change construction.

10 Claims, 7 Drawing Sheets

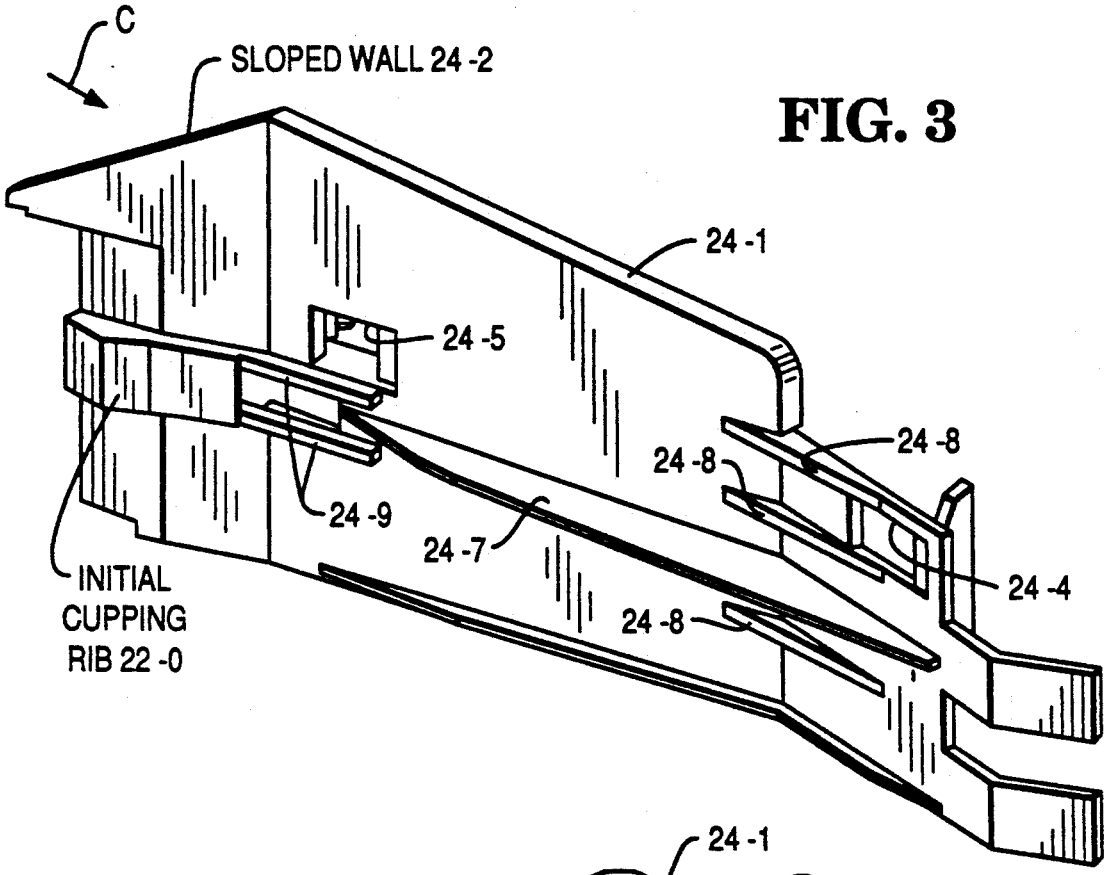
FIG. 3
FIG. 10
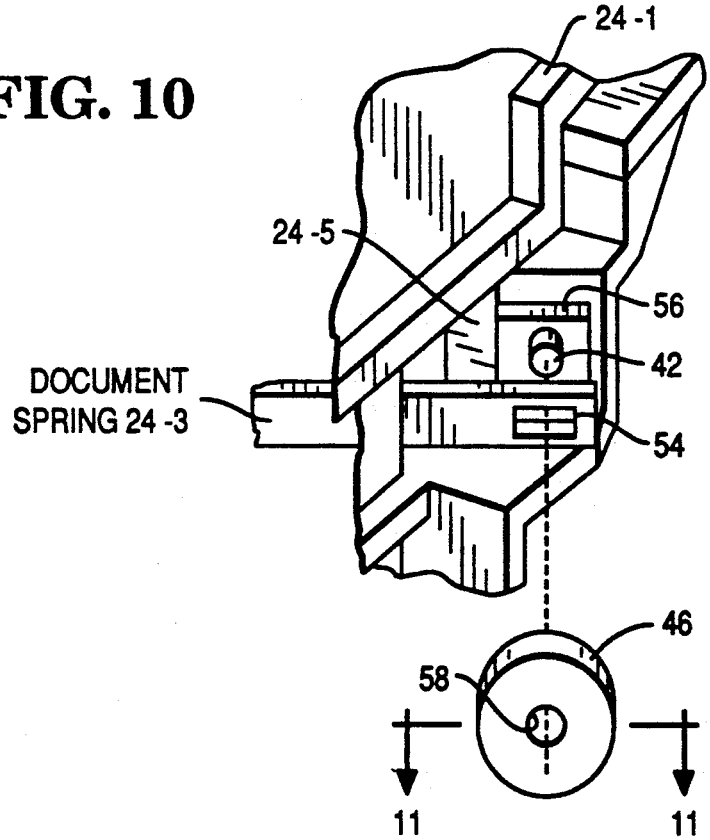

DOCUMENT STACKING APPARATUS

BACKGROUND OF THE INVENTION

1. Field of the Invention

This invention relates to a document pocketing apparatus which is used to guide and stack documents into a pocket as is done in high speed document processing machines, like proof and sorting machines, for example.

2. Background Information

Some of the problems with feeding financial documents, like checks, for example, are due to the extreme variation in size and condition of the documents and to the materials from which these documents are made. For example, the sizes of the documents processed in a financial proof machine can range from 2½ to 4½ inches in height and from 4½ to 9 inches in length in an intermixed batch of documents. Many of the documents have been carried in wallets and have a "U"-shaped bend in them. Others are "dog eared" or cut and have wrinkles in them. Some checks are very thin and flexible while other checks are stiff and made from card stock. It is apparent that when 250 to 300 of such documents are grouped together to be processed in a batch as is done in processing financial documents, the variation in size, condition, and material mentioned presents problems.

One of the operations which is performed in the processing of financial documents is to process a batch of such documents on a machine which performs a sorting function. The machine has a plurality of pockets into which the documents are routed and stacked based on certain data read from the documents. For example, all the documents of a certain type or destination end up in a designated pocket while being retained in the processing sequence. As the documents accumulate in the pocket, the documents have a tendency to "fan out" and rest against a rib (feeding line) along which the incoming documents are guided. When this happens, the leading edge of the next incoming document may hit the trailing edges of the pocketed documents causing problems. Often, this results in the incoming document being pocketed out of sequence with regard to the processing sequence mentioned. A worse result is to have the leading edge of an incoming document crash into the trailing edge of a pocketed document, resulting in a jam which requires the machine operator to stop the machine and clear the jam. Very often, the incoming document is crushed in accordion-like fashion by such a jam, making the crushed document unsuitable for further machine processing.

SUMMARY OF THE INVENTION

The present invention obviates the problems mentioned above. In a preferred embodiment, the document handling apparatus made according to this invention comprises:

a planar support;

a document track having a drive roller moving a document therein;

a cupping drive roller assembly mounted on said planar support to receive a document to be cupped; and an idler roller;

said cupping drive roller assembly having first, second, and third drive rollers dimensioned to cup said document in cooperation with said idler roller; and said second drive roller being positioned between said first and third drive rollers and being effective to pull said document from said drive roller in said document track.

Some of the features of this invention are:

1. It is low in cost;
2. It is easy to manufacture;
3. It provides a low level of noise compared to prior art apparatuses; and
4. It provides a long life for a special document spring used therein.

The above features, and others will be more readily understood in connection with the following Description, claims, and Drawing.

BRIEF DESCRIPTION OF THE DRAWING

FIG. 1 shows a receptacle means for receiving stacked documents, an entry drive roller means for receiving a document to be pocketed, a cupping means for cupping the document, and a wave guide means to facilitate pocketing the document in the receiving means.

FIG. 3 is a is a general perspective view of a guide member associated with the wave guide means shown in FIG. 1, with FIG. 3 being viewed from the direction of arrow A shown in FIG. 1.

FIG. 10 (shown on the sheet containing FIG. 3) is a general perspective view, taken along the direction of arrow D of FIG. 1 to show additional details of a mounting means for securing the ends of the document spring shown in FIG. 1.

DESCRIPTION OF THE PREFERRED EMBODIMENT

Figure 1:
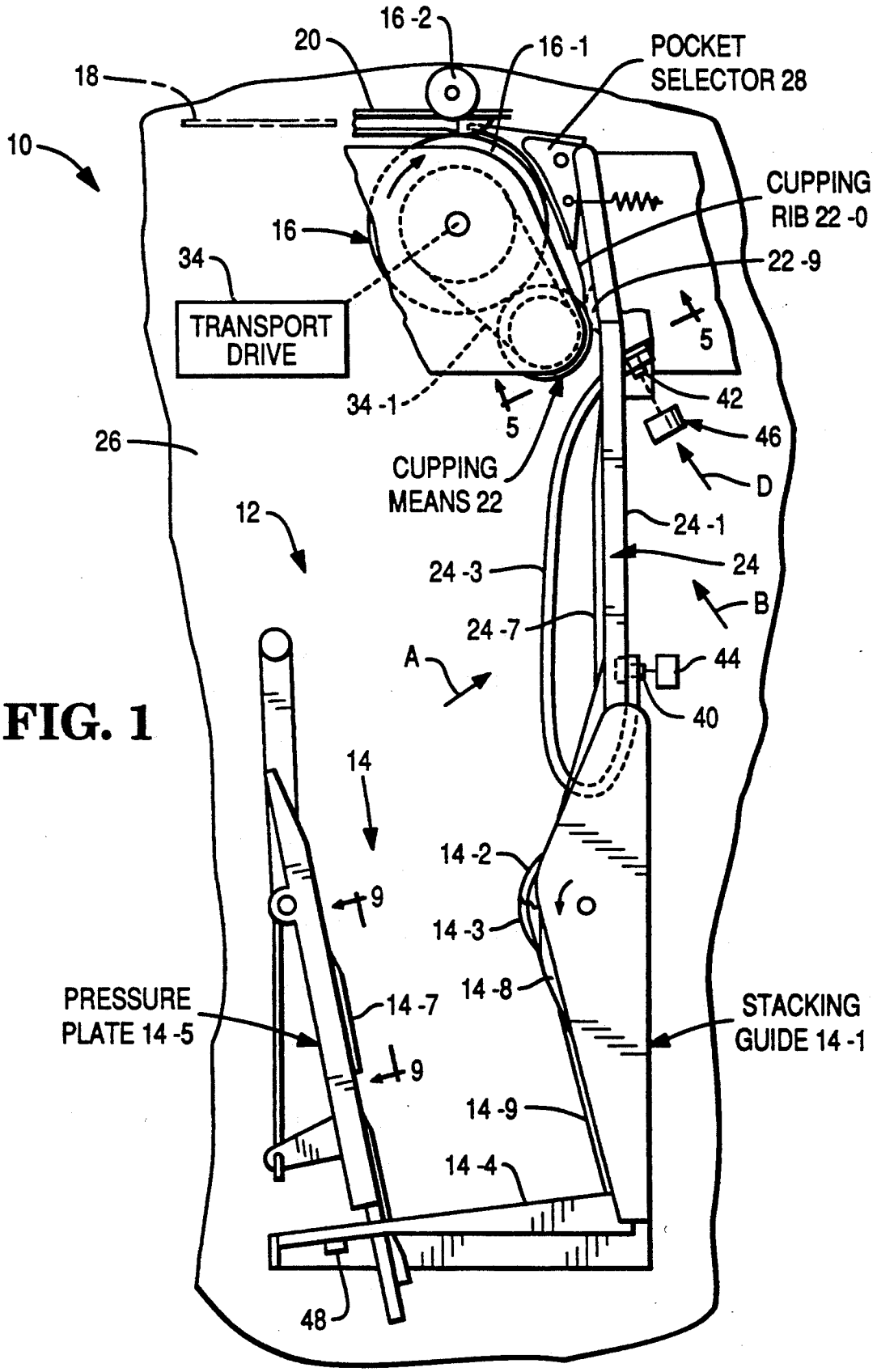
FIG. 1 is a plan view of a portion of a document handling apparatus, like a document sorting machine, in which a preferred form of this invention is incorporated.

FIG. 1 is a general plan view of a portion of a document processing machine, like a document sorting machine, designated generally as machine 10. The document handling apparatus of this invention is included in the machine 10 and is designated generally as apparatus 12.

The apparatus 12 includes a receptacle means 14 for receiving or pocketing documents to be stacked therein; an entry drive roller means 16 for receiving a document 18 from a document track 20; a cupping means 22 for cupping the document 20 to be stacked; and a wave guide means 24 which facilitates moving the trailing edges of the documents already in the receptacle means 14 out of the way of the leading edge of a document to be pocketed in the receptacle means 14. The receptacle means 14, the entry drive roller means 16, the cupping means 22, and the wave guide means 24 are all mounted on a planar member or support 26.

Figure 2:
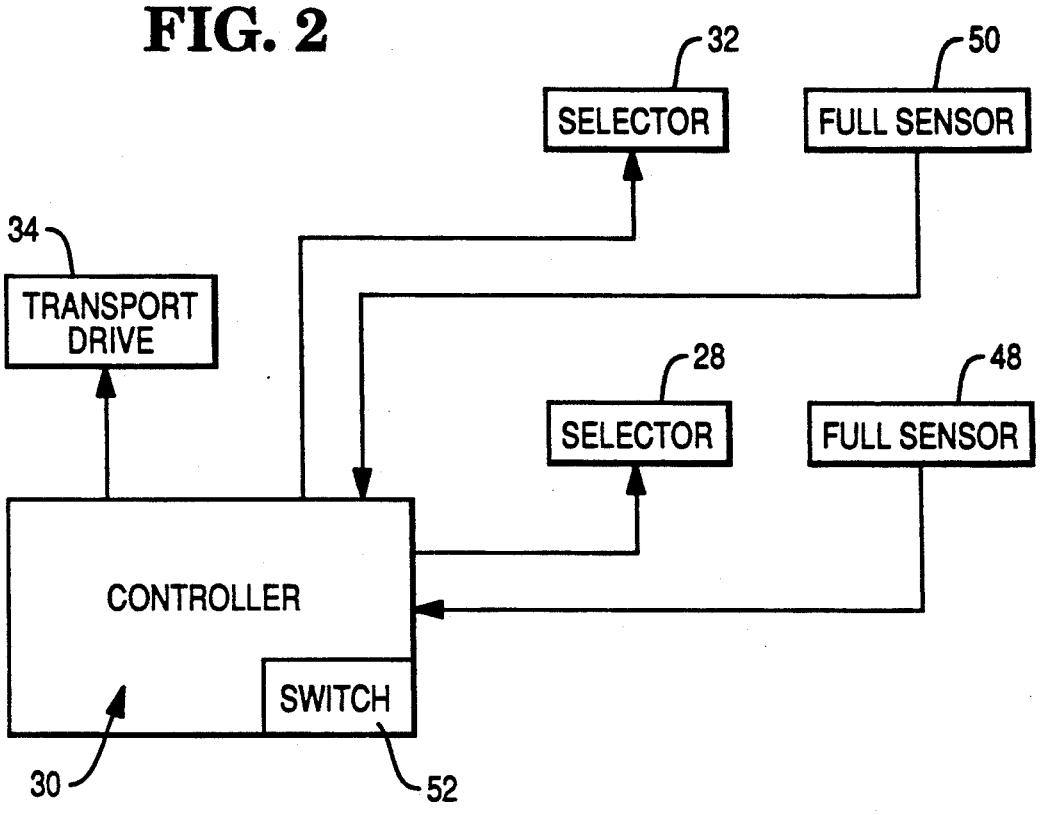
FIG. 2 is a schematic diagram showing a controller used with the apparatus shown in FIG. 1.

The machine 10 may include a plurality of the "pockets", like apparatus 12 shown in FIG. 1. As the document 18 moves along the document track 20 (from left to right as viewed in FIG. 1), a conventional pocket selector 28 is used to divert the document 18 from the document track 20 to the apparatus 12. The selector 28 is controlled by a controller 30 shown in FIG. 2. In one position, the selector 28 is used to divert all those documents which should be pocketed in the apparatus 12 into the apparatus 12, and in a second position, it is used to permit the documents to be pocketed in other pockets to be moved downstream to such additional pockets (not shown). A selector, like 32 (FIG. 2), may be used for such additional pockets or apparatuses.

The entry drive roller means 16 (FIG. 1) includes a drive roller 16-1 and an associated pinch roller 16-2 to move a document 18 along the document track 20. A conventional transport drive 34, under the control of the controller 30, is used to rotate the drive roller 16-1.

When a document 18 is to be pocketed in the apparatus 12, the controller 30 actuates the selector 28 to divert the document 18 towards the apparatus 12. The document 18 is partially bent as it travels around the periphery of the drive roller 16-1 in moving towards the cupping means 22. The cupping means 22 includes an initial cupping rib 22-0 which is located on a guide member 24-1 associated with the wave guide means 24. The guide member 24-1 is shown in more detail in FIG. 3, along with the location and shape of the cupping rib 22-0 located thereon.

One of the features of the apparatus 12 relates to a sloped wall 24-2 on the guide member 24-1. When a very thin or flimsy document 18 passes around the drive roller 16-1, centrifugal force tends to force the top edge of the document 18 away from the drive roller 16-1. With the sloped wall 24-2, a thin document 18 is supported as it rides up the sloped wall 24-2 in moving in the direction of arrow C in FIG. 3. The cupping rib 22-0 facilitates the start of the cupping process, and the cupping is completed by a cupping drive roller assembly which includes first, second, and third drive rollers 22-1, 22-2, and 22-3, respectively, (shown in FIG. 5). The initial cupping rib 22-0 minimizes the noise generated by the document encountering the drive rollers 22-1, 22-2, and 22-3. This is an important feature, especially when the apparatus 12 is to be used in an environment where excessive noise is undesirable, as in a banking environment.

Figure 5:
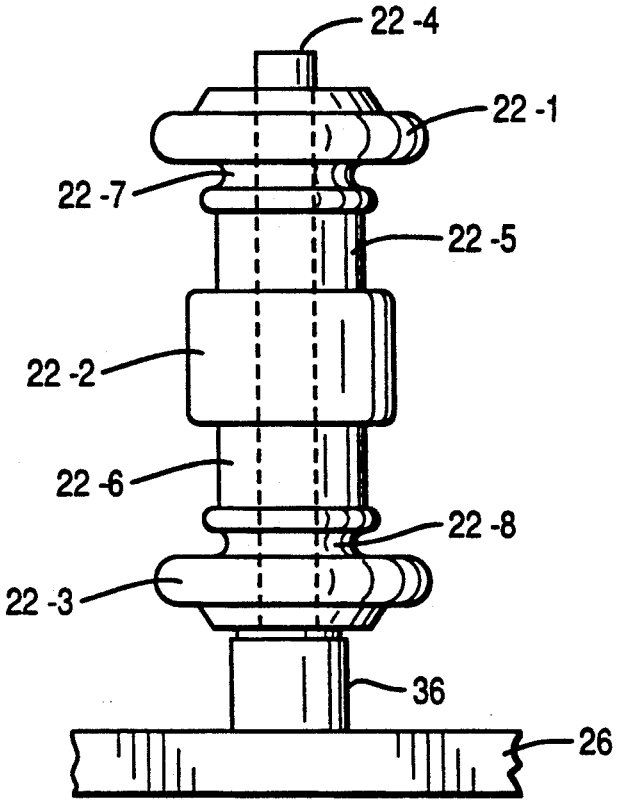
FIG. 5 is an elevational view, taken along the line 5—5 of FIG. 1 to show additional details of drive rollers associated with the cupping means shown in FIG. 1.

The first, second, and third drive rollers 22-1, 22-2, and 22-3 are mounted on a shaft 22-4 with suitable spacers 22-5 and 22-6 and O-ring drive portions 22-7 and 22-8 as shown in FIG. 5. The first and third rollers 22-1 and 22-3 are made of a "hard drive" material while the second drive roller 22-2 is made of a "soft drive" material, with the first and third rollers mentioned being equidistantly spaced from the second drive roller 22-2.

As used herein, a soft drive material has a higher coefficient of friction than does a hard drive material, and in the embodiment described, the second drive roller 22-2 is made of a resilient material like nitrile rubber, for example. For a hard drive material, polycarbonate plastic may be used. In effect, there are two drive forces being applied by two different materials (those just named) at three locations, namely, by drive rollers 22-1 and 22-3 and by the second drive force associated with the second drive roller 22-2 and its associated pinch roller 22-9.

Figure 6:
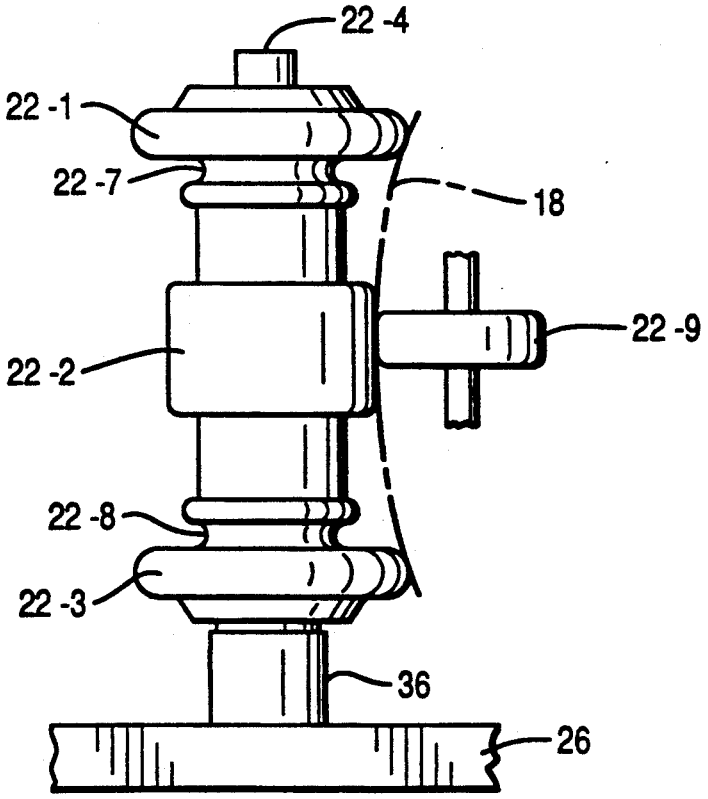
FIG. 6 is a view, similar to FIG. 5, to show how a document is cupped by the drive rollers and a bearing or pinch roller.

The pinch roller 22-9 (FIG. 6) is resiliently biased into engagement with the second drive roller 22-2 and, in effect, is a steel roller bearing. By the construction described, the second drive roller 22-2 tends to supplement the pull of the document 18 from the entry drive roller means 16. This action reduces a ripple effect caused when a document reacts to the usual "cornering motion" in prior art devices when passing around a drive roller prior to encountering a cupping device. Reducing the ripple effect reduces the noise associated with the apparatus 12. This is a feature of the apparatus 12, with FIG. 6 showing the document 18 (in dashed outline) being cupped by the cupping means 22.

Another feature of the cupping means 22 is that it can be assembled one way or 180 degrees relative to this one way with no loss in function. This is because the first and third drive rollers 22-1 and 22-3 are equidistantly spaced from the second drive roller 22-2, with the same being true for the O-ring drive portions 22-7 and 22-8 relative to second drive roller 22-2. The rod 22-4 is supported in a support 36 secured to the planar support 26. O-ring belts, like belt 34-1 shown in FIG. 1, engage the drive portions 22-7 and 22-8 to rotate the first, second, and third drive rollers 22-1, 22-2, and 22-3. The O-ring belts 34-1 are coupled to the drive rollers 16-1. The dimensions and geometry of the drive rollers 16-1 and the drive rollers 22-1, 22-2, and 22-3 are such as to enable the second drive roller 22-2 to pull the document 18 from the drive rollers 16-1 as previously discussed.

Figure 7:
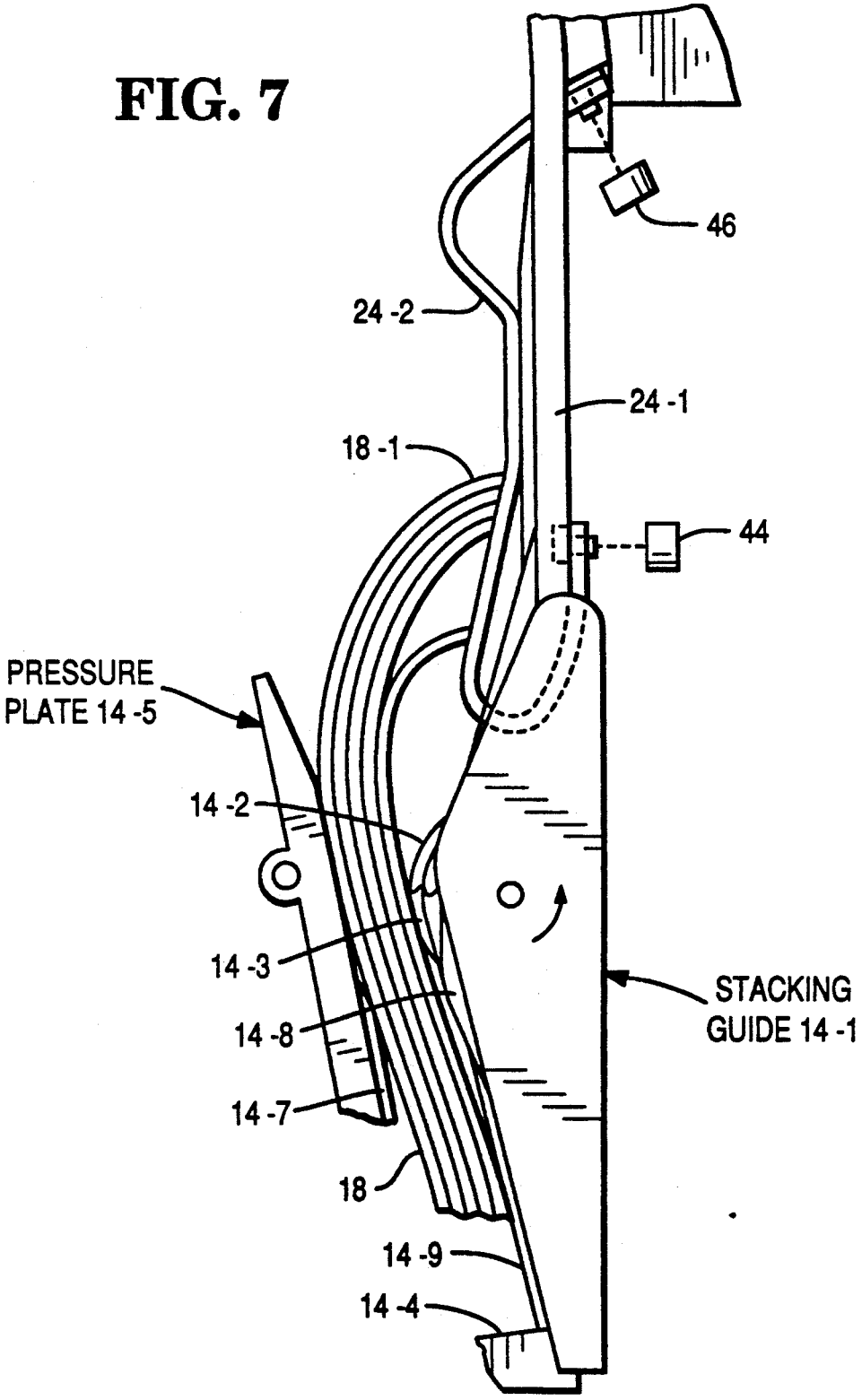
FIG. 7 is a view similar to FIG. 1, showing how the trailing edges of documents already in the receptacle means tend the block the passage of the next document to be pocketed therein.

The wave guide means 24, alluded to earlier herein with reference to FIG. 1, includes a wave guide member or document spring 24-3 shown in FIG. 1. U.S. Pat. No. 4,640,505, which is assigned to the same assignee as is the present application, explains the general functioning of a document spring generally similar to the document spring 24-3. FIG. 1 shows the position of the document spring 24-3 when no documents are in the receptacle means 14. (The pressure plate 14-5 is displaced in FIG. 1 from its normal position which is biased to the right as shown in FIG. 7.) One end of the document spring 24-3 passes through an opening 24-4 in the guide member 24-1 (FIG. 3), and the remaining end thereof passes through an opening 24-5 in the guide member 24-1.

Each of the ends of the document spring 24-3 has a rectangular opening therein which passes over a circular post, like 40 and 42 shown in FIG. 1, and fits on to a mating rectangular boss 56 (FIG. 10) as will be discussed hereinafter. The alignment of the post 42 is such that its longitudinal axis is substantially parallel to the direction that the document 18 assumes when being moved from the entry drive roller means 16 towards the guide member 24-1. The post 40 is substantially perpendicular to the guide member 24-1. A button 44 fits over the post 40 to retain the end of the document spring 24-3 on its associated rectangular boss and similarly, a button 46 fits over the post 42 to retain the remaining end of the document spring 24-3 on its associated rectangular boss 56. The construction associated with the buttons 44 and 46 provides an easy way for an operator of the machine 10 to replace the document spring 24-3 when necessary.

FIG. 7 is a view, similar to FIG. 1, showing how the trailing edges 18-1 of documents 18 already in the receptacle 14 means tend the block the entry of the next document to be pocketed therein.

Figure 8:
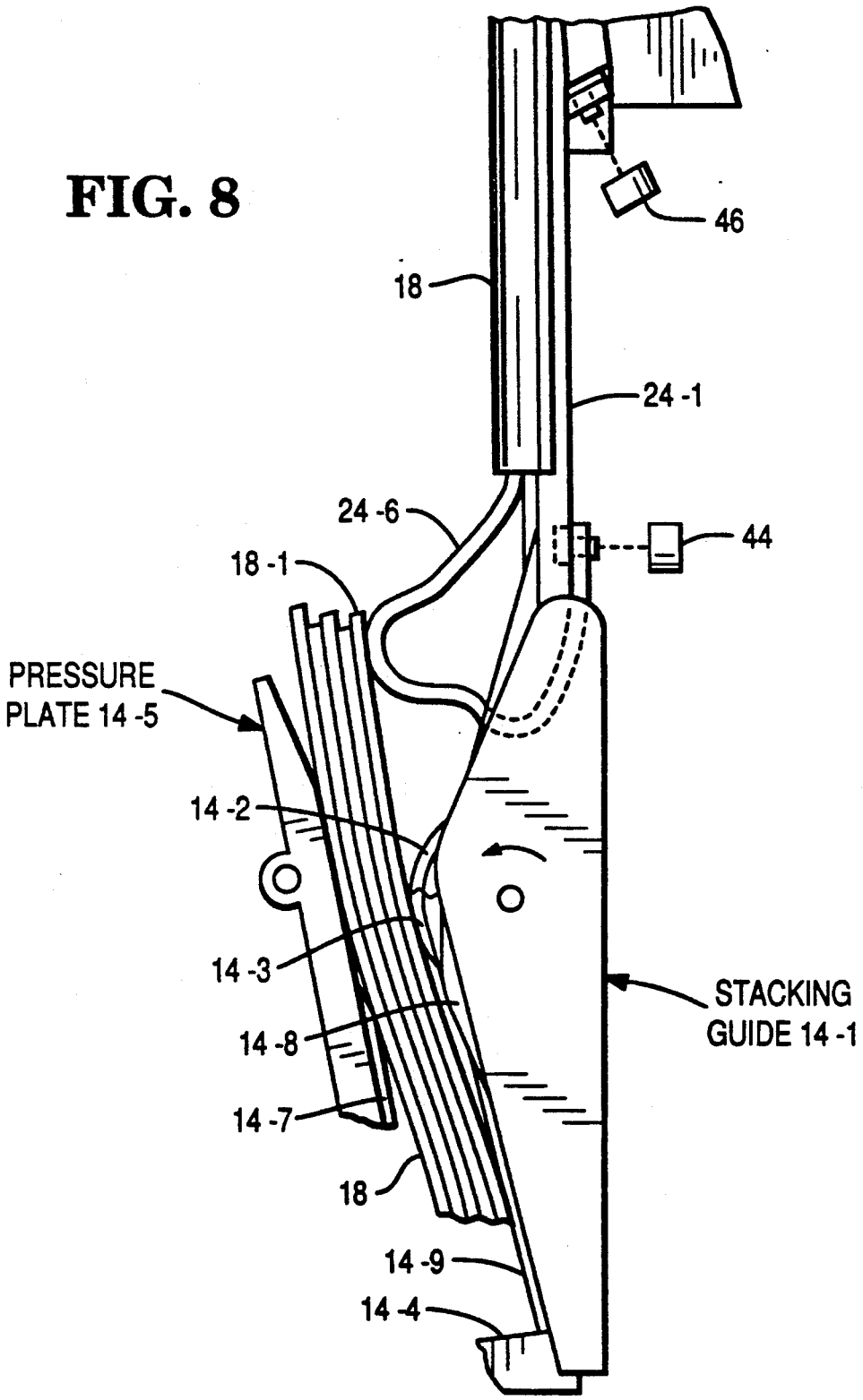
FIG. 8 is a schematic showing of how a "wave" developed by the document pushing the document spring tends to move the trailing edges of those documents already in the receptacle means out of the way of the next incoming document.

FIG. 8 is a schematic showing of how a "wave" 24-6, developed by the document 18 pushing the document spring 24-3, tends to move the trailing edges 18-1 of those documents already in the receptacle means 14 out of the way of the next incoming document 18. As the leading edge of the document 18 enters the receptacle means 14, the wave 24-6 which was developed, tends to move out of the opening 24-4 (FIG. 3) in the guide member 24-1. The wave guide means 24 also includes a rib 24-7 (FIG. 3) located on the guide member 24-1 which helps to maintain the cupping of the document 18 as it is moved towards the receptacle means 14. There are also three ribs 24-8 (FIG. 3) located on the guide member 24-1; these three ribs assist the document spring 24-3 from exerting increasing pressure on the document 18, and they provide a smooth transition to the drive rollers 14-2 and 14-3 (FIG. 1). Ribs 24-9 located on opposed sides of the rib 24-7 also facilitate the cupping function.

As the leading edge of the document 18 enters the receptacle means 14, it encounters the lower and upper stacking drive rollers 14-2 and 14-3 (FIG. 1) which drive the leading edge of the document 18 towards a stop 14-4. These stacking drive rollers 14-2 and 14-3 are conventionally driven in a counter-clockwise direction (as viewed in FIG. 8) by the transport drive 34 shown in FIG. 1. The receptacle means 14 also has a conventional pressure plate 14-5 which is conventionally biased to move towards the stacking guide 14-1 as shown in FIGS. 7 and 8.

Figure 9:
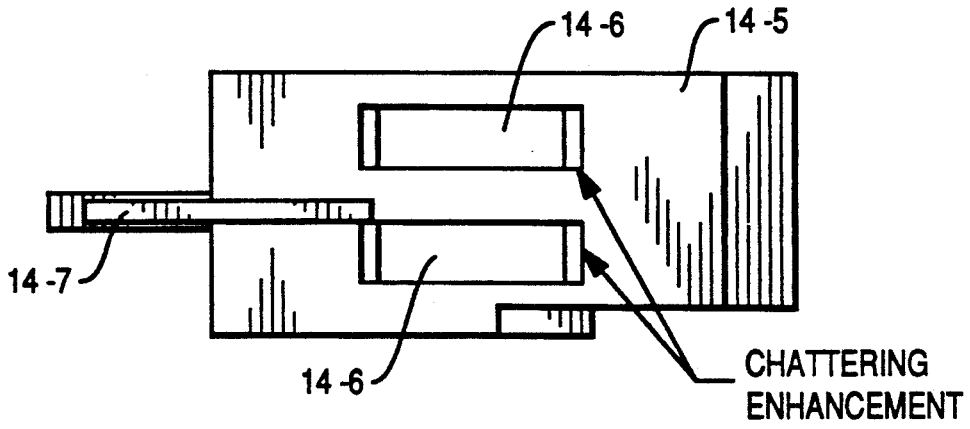
FIG. 9 (shown on the sheet containing FIG. 2) is a general view, taken along the line 9—9 of FIG. 1, to show a portion of a pressure plate included in the receptacle means and to show additional details of a rib located n the pressure plate shown in FIG. 1.
Figure 4:
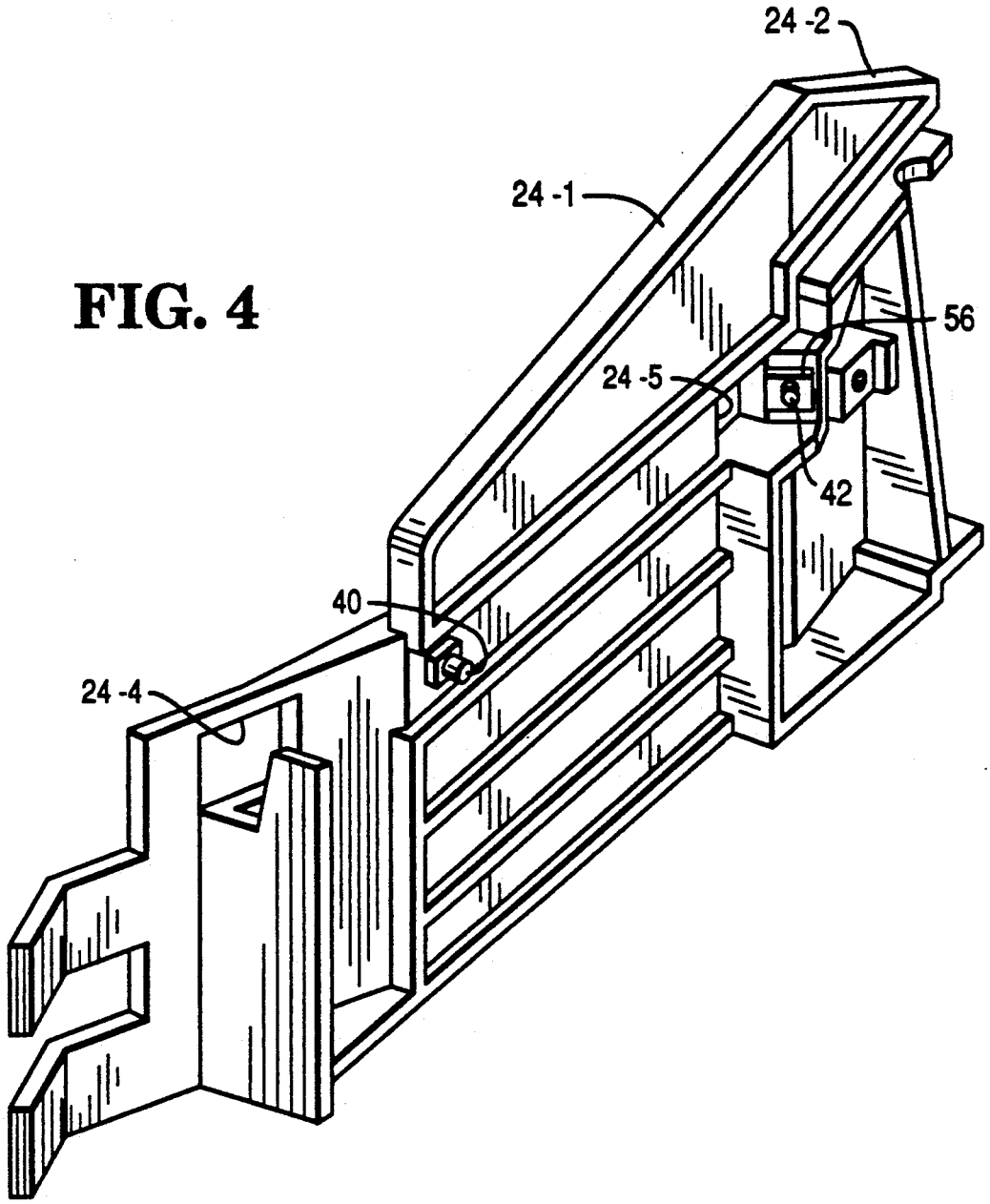
FIG. 4 is a general perspective view of the guide member shown in FIG. 3, with FIG. 4 being viewed from the direction of arrow B of FIG. 1.

The pressure plate 14-5 has clearances or openings 14-6 therein to prevent the lower and upper stacking drive rollers 14-2 and 14-3 from abrading thereagainst when the receptacle means 14 has no documents therein. The receptacle means 14 also includes ribs 14-7 and 14-8 which prevent a chatter caused by the first or first few documents 18 entering the receptacle means 14. The rib 14-7, shown in FIG. 9, is located on the pressure plate 14-5 below the opening 14-6, and the rib 14-8 is located on the stacking guide 14-1 above the stacking drive roller 14-2. Rib 14-9 is located on the stacking guide 14-1 and is centered between the drive rollers 14-2 and 14-3. As documents 18 are stacked within the receptacle means 14, the pressure plate 14-5 moves away from the stacking guide 14-1 until the pressure plate 14-5 cooperates with a "full" sensor 48 (FIGS. 1 and 2) to indicate to the controller 30 and the operator of the machine 10 that then receptacle means 14 is full. The operator can the remove the stack of documents 18 from the receptacle means 14 to repeat the process. An additional full sensor 50 is shown for an adjacent apparatus (not shown) similar to apparatus 12. An off/on switch 52 is shown for the controller 30.

Figure 11:
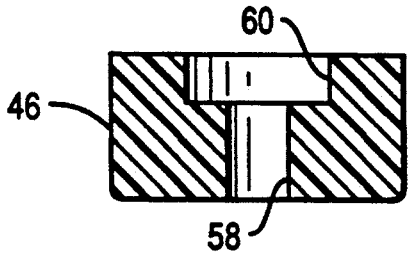
FIG. 11 (shown on the sheet containing FIG. 4) is a cross sectional view taken along the line 11—11 of FIG. 10 to show additional details of a button shown in FIG. 10.

FIG. 10 shows the structure for securing the document spring 24-3 to the wave guide means 24. In this regard, the post 42 receives the rectangular opening 54 in the end of the document spring 24-3 after being inserted through the opening 24-5. The post 42 extends from a quadrilaterally or rectangularly-shaped boss 56 which is part of the wave guide means 24. The rectangular opening 54 in the document spring 24-3 fits onto the rectangular boss 56 to maintain the document spring 24-3 in the proper position as shown in FIG. 1. The button 46 is made of a resilient material and has a round hole 58 therein to fit on the post 42 and a round hole 60 (FIG. 11) to fit on the rectangular boss 56. The round hole 60 is forced over the square boss 56 without any need for orientation. This is a feature which enables an operator of the machine 10 to replace the document spring 24-3 when necessary. The post 40 and the button 44 have a construction which is similar to that just described relative to post 42 and button 46.

A feature of this invention is that the receptacle means 14, the entry drive roller means 16, the document track 20, the cupping means 22, and the wave guide means 24 are all mounted on the same level on the planar support 26. In some of the prior art apparatuses, the receptacle means was lower than the document track; this meant that as a document was fed from the document track to the receptacle means, the lower leading edge of the document would "crash" into the support plate, causing some crimping of the lower edge. This caused some jamming of documents at the receptacle means.

Another feature is that the cupping rib 22-0 initiates the cupping of the document 18; however, more importantly, it reduces the impact of the leading edge of the document 18 as it approaches the cupping means 22, and this reduces the noise of such an impact.

The clearance openings 24-5 and 24-4 (FIG. 3) in the guide member 24-1 enable the document spring 24-3 to provide an improved performance compared to prior art devices. In the embodiment described, the document spring 24-3 has a width of 0.334 inch, a thickness of 0.003 inch, and is made of KAPTON plastic material. The first opening 24-5 reduces the impact that the leading edge of the document 18 encounters when first contacting the document spring 24-3; however, it still permits the leading edge to create the wave 24-6 shown in FIG. 8. When the wave 24-6 (formed by the document 18) reaches the second opening 24-4, the document 18 forces the wave through the opening 24-4. This construction consistently locates the entry point at which the document 18 enters the receptacle means 14. Because the stacking drive rollers 14-2 and 14-3 are located relative to the opening 24-4, it means that the leading edge of each of the documents entering the receptacle means 14 does so at about the same point relative to these rollers 14-2 and 14-3. With the construction described, the document spring 24-3 of the present apparatus 12 has been used to pocket over 7,000,000 documents while showing no signs of wear, whereas a document spring used in the apparatus disclosed in the patent mentioned earlier herein had a useful life of pocketing about 1,000,000 documents.

The stacking drive rollers 14-2 and 14-3 are made of nitrile rubber and are spaced apart and parallel to each other so as to drive the document 18 towards the stop 14-4 without any tilting or skewing.

What is claimed is:

1. A document handling apparatus comprising:

a receptacle means for receiving documents to be stacked therein, with said receptacle means having an entrance area, an end wall, a pressure plate, and a pair of stacking drive rollers to move a document to be pocketed towards said end wall, and with said documents having trailing edges which at times block said entrance area;

an entry drive roller means for receiving a document to be pocketed in said receptacle means;

a cupping means having first, second, and third drive rollers and an idler roller for cupping said document, with said idler roller cooperating with said second drive roller to pull said document from said entry drive roller means and to drive said document in free flight towards said pair of stacking drive rollers;

a wave guide means for facilitating the entry of documents into said receiving means, said wave guide means including a flexible band positioned between said cupping means and said pair of drive rollers, with said flexible band forming a wave when the leading edge of said document to be pocketed impacts said flexible band such that said wave moves the trailing edges of documents already in said receiving means out of said receiving area; and a planar member, with said receptacle means, entry drive roller means, cupping means, and wave guide means mounted on said planar member;

said wave guide means including a guide member mounted on said planar member, with said guide member having a cupping rib positioned thereon to start an initial cupping of said document prior to said document reaching said cupping means.

2. The document handling apparatus as claimed in claim 1 in which said guide member has first and second openings therein, and in which said flexible band has first and second ends which pass through said first and second openings, respectively;

said first and second ends each having an opening therein;

said guide member having first and second means for detachably securing said first and second ends, respectively, thereto, by using said openings in said first and second ends of said flexible band for locating said first and second ends in said first and second means.

3. The document handling apparatus as claimed in claim 2 in which said openings in said first and second ends are quadrilateral in shape and in which said first means includes a quadrilateral boss and a pin upstanding therefrom to enable the opening in said first end of said flexible band to be mounted on said quadrilateral boss;

said first means also including a flexible button which fits over said pin and quadrilateral boss to detachably secure said first end thereto; and said second means being identical to said first means to detachably secure said second end thereto.

4. The document handling apparatus as claimed in claim 2 in which said first opening in said guide member is located near said cupping means.

5. The document handling apparatus as claimed in claim 4 in which said second opening in said guide member is located near said entrance area and said pair of drive rollers of said receptacle means.

6. The document handling apparatus as claimed in claim 5 in which said guide member has a rib positioned between said pair of drive rollers and said end wall and said pressure plate has a rib thereon to minimize chatter caused by at least one said document in said receptacle means.

7. The document handling apparatus as claimed in claim 6 in which said guide member has third, fourth, and fifth ribs positioned near said second opening therein.

8. The document handling apparatus as claimed in claim 1 in which said guide member has a sloped wall thereon near said cupping rib to support said document as the document is moved towards said cupping means.

9. The document handling apparatus as claimed in claim 1 in which said flexible band is made of KAPTON plastic material.

10. The document handling apparatus as claimed in claim 1 in which said third drive roller of said cupping means is made of nitrile rubber.

* * * * *